US005855730A

United States Patent [19]

Brusehaber et al.

[11] Patent Number: 5,855,730

[45] Date of Patent: Jan. 5, 1999

[54] GLUE ACTUATOR MOUNTING FOR A FORM-FOLDING AND GLUING MACHINE

[75] Inventors: Carl W. Brusehaber, Lakewood; David C. Evans, Norwalk, both of Calif.

[73] Assignee: Glue Fold, Inc., Newark, Calif.

[21] Appl. No.: 773,871

[22] Filed: Dec. 27, 1996

[51] Int. Cl.[6] ..... B31F 1/10

[52] U.S. Cl. ..... 156/443; 156/217; 156/227; 156/357; 156/578; 493/408; 493/409; 493/420; 493/421; 118/256; 118/32; 270/39.05

[58] Field of Search ..... 493/420, 421, 493/408, 409, 442; 156/357, 356, 443, 539, 578, 227, 217, 548; 118/255, 256, 32, 668, 676, 313, 315; 270/39.01, 39.05, 32

[56] References Cited

U.S. PATENT DOCUMENTS 1,833,296 11/1931 Mentges ..... 493/420
3,211,448 10/1965 Stoothoff ..... 493/421
4,518,380 5/1985 Shimizu et al. ..... 493/420
5,048,809 9/1991 Tebbe et al. ..... 270/45
5,221,402 6/1993 Westra et al. ..... 156/314

*Primary Examiner*—David A. Simmons
*Assistant Examiner*—Linda L. Gray
*Attorney, Agent, or Firm*—Donald R. Boys

[57] ABSTRACT

A glue actuator mounting assembly adapted to mount to a folder apparatus has individual opposed guide strips forming a sheet path and glue actuators slidably mounted across the sheet path, such that individual actuators may be moved and repositioned laterally, and guide strips may be positioned to allow each glue actuator, regardless of lateral position, to have access to a sheet moving in the sheet path. In a preferred embodiment a stop bar is included having extendable tabs for extending between guide strips and forming a stop for sheets moving in the sheet path. In a preferred embodiment the actuators are mounted on slide rods that engage open slots in a carriage of the actuator mounting assembly such that the rods carrying the actuators, along with the actuators, may be lifted off the actuator mounting assembly.

8 Claims, 9 Drawing Sheets

GLUE ACTUATOR MOUNTING FOR A FORM-FOLDING AND GLUING MACHINE

FIELD OF THE INVENTION

The present invention is in the area of apparatus and methods for folding and gluing forms, and pertains more specifically to parts of such machines adapted for mounting and positioning glue guns, also called actuators, relative to other parts of such apparatus and relative to forms being processed in such apparatus.

BACKGROUND OF THE INVENTION

In commercial operations where very large numbers of similar documents must be produced and mailed, a very small savings per document will translate into a large saving over the many documents. Examples of such documents are payroll checks, direct mail solicitations, 1099 forms, invoices, business statements, coupons, sales pieces, student grade reports, membership notices, and so forth. There are many other examples.

Traditional expenses for such operations include the cost of printing the documents, and labor for such tasks as folding, stuffing envelopes, and addressing.

In recent years, especially with the rapid growth of computer control techniques, equipment has been developed to produce self-mailers from single sheets. This process takes a single sheet and folds it in concert with an application of adhesive (or activation of existing areas of adhesive), perforates the edges for ease of opening, and seals the sheet into a unit known in the art as a self-mailer. The self-mailer becomes its own envelope, and no stuffing of envelopes is needed.

There are a number of different types of self-mailers known in the art and a number of different procedures for making them. For example, a type of adhesive that may later be activated with water may be applied to single sheets, which are then fed automatically through a laser printer, and then to a self-mailer machine that moistens the adhesive strips, folds the sheets, perforates the sheets appropriately for the particular form, and seals the unit together as a self-mailer. This kind of adhesive is the type used for flaps of most envelopes, and thus is familiar to most everyone.

The moistenable adhesive approach is used by manufacturers who judge it too difficult and troublesome to apply adhesive at the self-mailer machine; and if not done properly, applying glue at the self-mailer machine can be truly troublesome.

The pre-gluing approach, however, has its own drawbacks. For example, applying moistenable adhesive to the single sheets cannot normally be done in concert with printing, because the adhesive must be allowed to cure before coming in contact with the printing equipment or even other single sheets. Moreover, even cured, the moistenable adhesive is often not compatible with printing equipment, especially laser printers which operate by applying a high local temperature to the paper upon which printing is to be done. The high temperature often softens the adhesive and renders it tacky, creating jams and cleaning problems. Further, moistening the adhesive in the self-mailer machine can be just as troublesome as applying adhesive, because water can get onto regions where it isn't wanted and can also damage the equipment. Another drawback is that moistenable adhesive becomes more of a problem in warm and damp climates, such as in countries close to the equator.

The approach of moistenable adhesive to avoid applying adhesive at the self-mailer machine is often, therefore, more expensive than the problems it is meant to avoid. The application of the moistenable adhesive is a separate operation with its own attendant costs, the problems the adhesive causes in printing equipment, particularly laser printing equipment, slows down the printing operation making it more expensive, and no balancing savings is realized at the self-mailer machine.

Typically a form folding and gluing apparatus as described above has guide plates arranged in concert with rollers providing for guiding and folding paper sheets as described in more detail below. The guide plates in such machines typically have cut-out areas (openings) over which glue guns (actuators) are mounted in a manner to allow glue to be applied through the openings onto sheets guided between the plates. In some cases the actuators are positioned to apply glue along an edge of a moving sheet as the sheet passes the actuator. In other cases actuators are positioned to apply a spot or spots of glue along an edge or fold line at right angles to the direction of travel of a sheet through the apparatus. It is the latter case with which the present invention is principally concerned.

Conventional machines are designed with specific opening as described above, and mountings are designed to position the actuators with little or no flexibility of position. As a result only a limited range of different sorts of mailers may be processed with a particular set of guide plates and associated actuator mountings.

What is needed is a modular and very adaptable apparatus allowing sheets to be reliably guided, actuators to mounted at essentially any position relative to processed sheets, thereby allowing glue to be applied at a much broader range of positions, and also allowing paper stops, which determine position of folds, to be adjusted without having to adjust actuator positions independently. The invention herein described provides such an apparatus, wherein moveable rails replace the traditional guide plates, and actuator mountings provide for essentially universal placement relative to sheet position.

SUMMARY OF THE INVENTION

In a preferred embodiment of the present invention a sheet stop and actuator mounting assembly for a sheet folding apparatus is provided, comprising a frame including cross members adapted for mounting to the sheet folding apparatus; a plurality of opposed guide strips slidably mounted to the cross members, the guide strips spaced apart and forming a sheet path wherein sheets may enter from and exit to the sheet folder apparatus; a carriage mounted to the frame to one side of the sheet path, the carriage adjustable in the direction of sheet movement in the sheet path, and adapted to engage two parallel rods to extend across the width of the sheet path; and a stop bar mounted to the carriage outside lateral edges of the sheet path, positioned to one side of the sheet path and extending laterally across the sheet path, the bar having extendable and retractable tabs adapted to extend between the guide strips across the sheet path, forming thereby a stop for sheets moving in the sheet path.

In some embodiments the carriage mounts by threaded blocks on threaded rods extending in the direction of sheet movement in the sheet path, whereby rotating the threaded rods adjusts carriage position along the threaded rods. The threaded blocks may comprise a quick-release mechanism, allowing the blocks to be disengaged from the threaded rods and moved along the length of the threaded rods without turning the threaded rods. In some embodiments the stop bar is mounted to the side of the opposed guide strips opposite the carriage, and in others the stop bar is mounted to the frame.

There may be in various embodiments two or more glue actuators slidably mounted on two parallel rods engaging the carriage and extending across the width of the sheet path, such that the two or more glue actuators may be moved laterally along the parallel rods. The actuators are adapted to be affixed to the parallel rods at any position along the parallel rods.

In another aspect of the invention a glue actuator assembly for a sheet folding apparatus is provided, comprising a frame including cross members adapted for mounting to the sheet folding apparatus; a plurality of opposed guide strips slidably mounted to the cross members, the guide strips spaced apart and forming a sheet path wherein sheets may enter from and exit to the sheet folder apparatus; and an actuator carriage mounted to the frame to one side of the sheet path and comprising two or more glue actuators slidably mounted on bars extending across the sheet path. In these embodiments two or more glue actuators may be positioned along the bars and the guide strips may be positioned to allow the glue actuators access to sheets in the sheet path. In these embodiments, too, the carriage is adjustable in the direction of sheets in the sheet path. The carriage may be mounted on threaded rods extending in the direction of sheet movement in the sheet path, an the carriage is adjusted by rotating the threaded rods. There may also be a stop bar extending across the sheet path to one side of the sheet path, the stop bar having extendable tabs adapted to extend between individual ones of the guide strips, forming thereby a stop for sheets moving in the sheet path.

Apparatus according to the various embodiments of the invention described provides a more versatile and useful folding and gluing apparatus than heretofore available, such that glue actuators are infinitely adjustable in position relative to sheets being folded, and may also be easily removed for service and cleaning.

DESCRIPTION OF THE PREFERRED EMBODIMENTS

General Description

Figure 1:
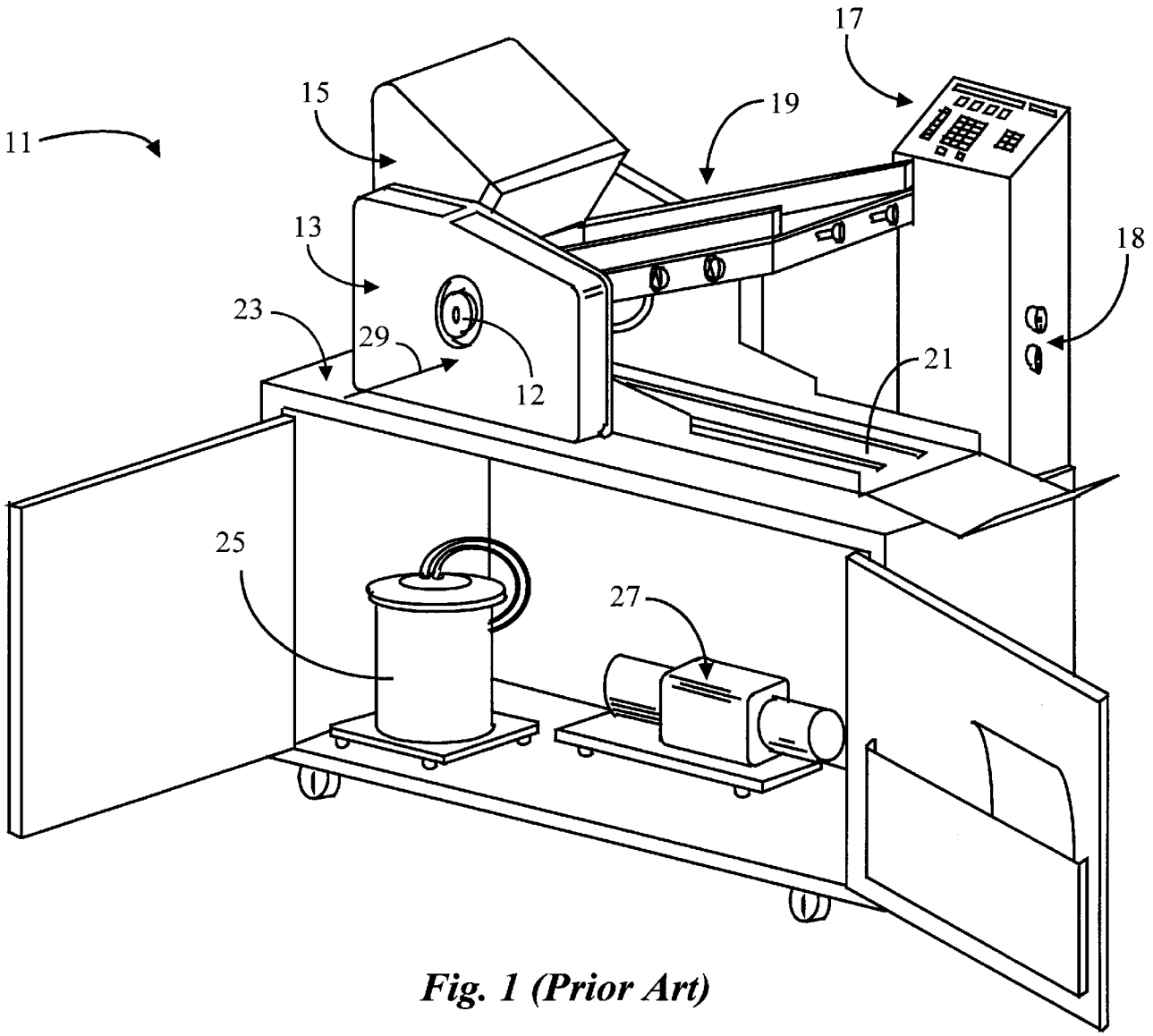
Fig. 1 (Prior Art)
FIG. 1 is an isometric view of a gluefolder system according to the prior art, and as used in embodiments of the present invention.

FIG. 1 is an elevation view of a folding and gluing machine 11. Such a machine is manufactured by GlueFold, Inc. of Newark, Calif., and is called the GlueFolder Model 503 machine. The GlueFolder Model 503 machine is a combination of a high-speed folder 13; an advanced, electronically-controlled gluing subsystem 15, which includes a system for feeding glue from a glue pot under pressure; perforators (not shown in FIG. 1); a microprocessor-based control subsystem 17, which includes double-sheet detection and jam protection; and conventional electrical power components. Connectors 18, which may be placed as shown or elsewhere on the cabinetry or frame of the machine, are for power and control connections between control sub-system 17 and optional equipment which may be added to the machine shown in FIG. 1.

The Glue-Folder 503 also comprises a sheet feeding sub-system 19 which features adjustment for sheet squareness and a vacuum feed wheel for maximizing high-speed performance. Finished self-mailers exit on a conveyor 21 which may be interfaced with other equipment, or mailers may be removed from the conveyor periodically as they accumulate.

The Glue-Folder 503 machine assembles to a support cabinet 23 which serves to present the apparatus at a convenient height and to house peripheral equipment such as a pressurized glue reservoir 25 and vacuum pump and compressor equipment 27. Equipment shown in cabinet 23 in FIG. 1 is intended to be representational rather than detailed. There are many other ways than those shown that the equipment may be arranged.

A central part of the Glue-Folder 503 machine is the sheet feeder and folder, comprising elements 13 and 19 (FIG. 1). The feeder/folder is capable of speeds of from 25,000 to 30,000 sheets per hour (sph), using 8.5×11 standard size sheets, with a full ream of sheets loaded in the feeder tray. Sheet stock may be from 13# bond to 70# coated stock. These features are a result of unique characteristics of the Elite 500 Super VF feeder/folder and the alterations made for the inventors, which are more fully described below.

Feeder/Folder

Figure 2:
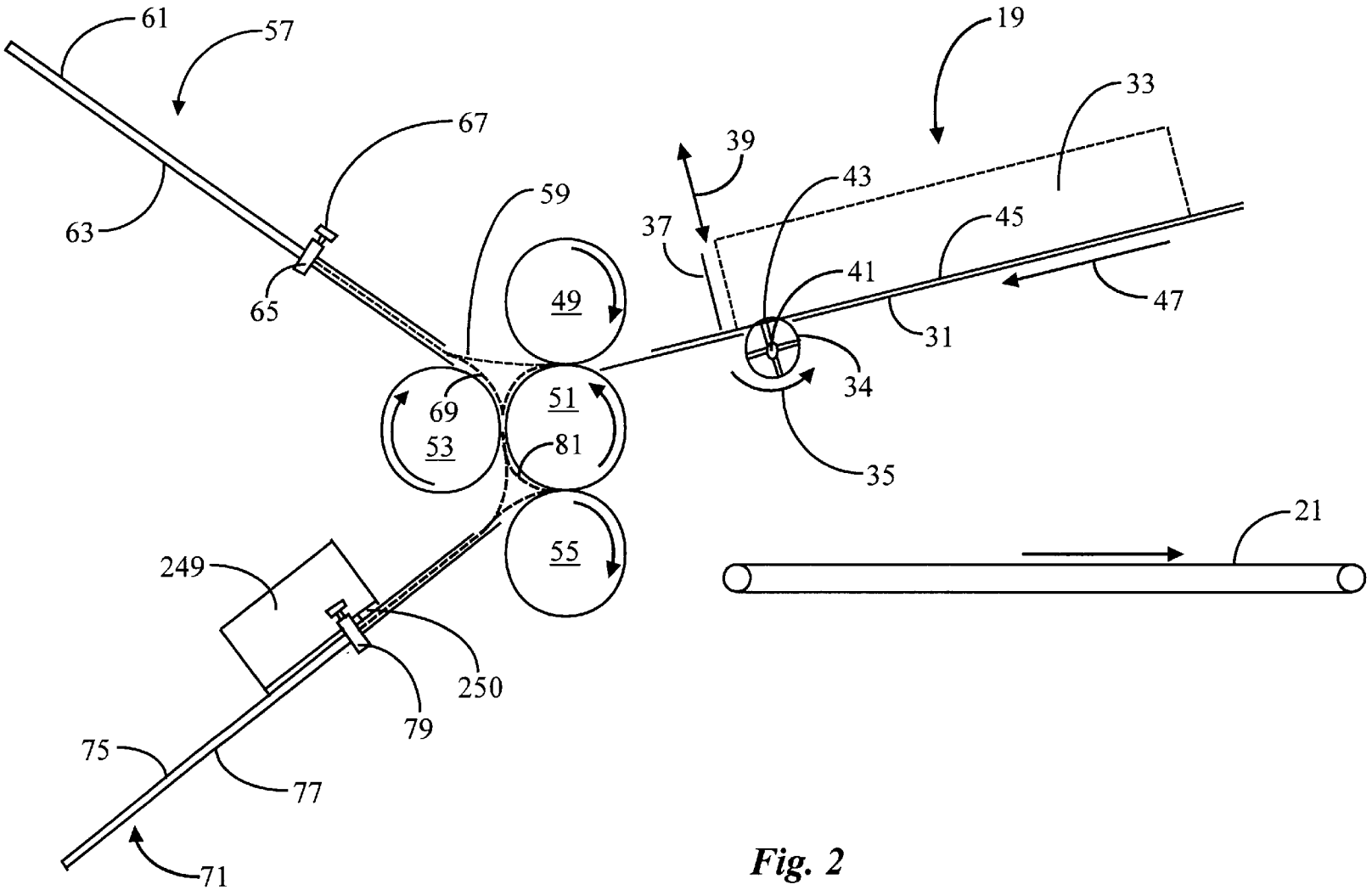
FIG. 2 is a partially diagrammatical view of a conventional folding apparatus as used in the present invention.

FIG. 2 is a side elevation, mostly schematic view showing the roller arrangement of the feeder/folder and some other elements of the self-mailer machine of the present invention. This view is in the general direction of arrow 29 in FIG. 1. Many of the frame members of the machine are not shown in FIG. 2 to avoid confusion and better illustrate the elements that directly effect feeding and folding forms.

Sheet feeding sub-system 19 indicated in FIG. 1 and FIG. 2 comprises a tray for holding a stack of sheets to be converted to self mailers. The tray is shown in FIG. 2 as a simple base plate 31, but actually comprises sides and adjusting apparatus. A stack of sheets to be fed is indicated in FIG. 2 by area 33 enclosed by dotted lines.

A vacuum operated feed wheel 34 extends through tray 31 in sheet-feeding sub-system 19 and is operated by a conventional motor drive (not shown) in the rotary direction of arrow 35. An adjustable paper stop 37 can be adjusted in the direction of arrow 39 to provide a gap with tray 31 so only a single sheet may be fed under the stop from stack 33 in the direction of arrow 47. Feed wheel 34 has passages from a center manifold 41 (passage 43 is exemplary), and is designed so only those passages facing the sheet stack are fed by vacuum as the feed wheel rotates. As passages, such as passage 43, contact sheet 45, which is the bottom sheet of the stack on tray 31, and feed wheel 34 continues to rotate bringing other vacuum passages into contact with sheet 45, sheet 45 is fed under paper stop 37. There are low-pressure air blowing passages (not shown) along the sides of tray 31 and a manifold (also not shown) near stop 37 to aid in separating sheets so only the bottom sheet feeds.

Sheet 45 is fed in the direction of arrow 47 until the leading edge of the sheet is engaged between rollers 49 and 51. Rollers 49 and 51 each turn in the direction of the arrows shown on the respective rollers, so the sheet engaged in the rollers is fed through the rollers (pulled from the bottom of the stack) toward an upper folding plate 57, which has upper and lower guide plates 61 and 63 respectively. Sheet 45 proceeds approximately along dotted line 59 and enters folding plate 57 between guide plates 61 and 63.

As the fed sheet proceeds upward between plates 61 and 63, it encounters a stop 65 which is adjustable in position along the length of the folding plate, and secured by conventional means such as a clamp screw 67. At the time that sheet 45 encounters stop 65, it is still engaged by rollers 49 and 51. The sheet can feed no further between plates 61 and 63, and continues to be fed, so the sheet folds down as shown approximately by dotted line 69, and is caught between rollers 51 and 53.

By being fed then down through rollers 51 and 53 a first fold is accomplished. The sheet then proceeds, folded edge leading, into a lower folder plate 71 along approximately line 73. Lower folding plate 71 comprises an upper and a lower guide plate 75 and 77, and an adjustable stop 79 similar to stop 65 on upper folding plate 57. The leading edge of the folded sheet, now engaged between rollers 49 and 51, and also between rollers 51 and 53, encounters stop 79, can proceed no further, and is subsequently bent along approximately line 81 until the sheet is caught and engaged between rollers 51 and 55. This action accomplishes a second fold, so there are them three distinct flat section, just as one typically folds a sheet for insertion into an envelope. Stops 65 and 79 may be adjusted at a wide variety of positions to change the position in the length of a sheet where the folds are made.

The folded sheet proceeds between rollers 51 and 55 and is deposited onto conveyor 21 to be conducted away from the feeder. The linear speed of the conveyor is relatively slow so a large number of folded sheets may be held on the conveyor as it moves.

The above discussion is meant to describe a typical folding action of a GlueFolder machine, but not the gluing and perforation. The actual output onto conveyor 21 from the self-mailer machine of the present invention is completed self-mailers rather than just folded sheets.

Rollers 49, 51, 53, and 55 span substantially the width of high-speed folder 13, and are driven in unison by conventional gears from a single drive motor through one of the sides of the folder. The rollers may also be rotated manually in unison by turning knob 12 (FIG. 1), which is useful in setup and adjustment procedures.

It will be apparent to one with skill in the art that a guide might be installed between where a folded sheet exits from rollers 51 and 53 to guide the sheet directly into engagement by rollers 51 and 55, so a single fold is made. In this case the lower folder plate is not needed. The position of stop 65 may also be adjusted to adjust the position of the single fold relative to an unfolded sheet. It will be apparent as well that the apparatus may also be arranged to use only the lower folding plate, and a wide variety of folds may be accomplished by such alterations and combination thereof.

The functions of the Feeder/Folder have been described in some detail above. It should be apparent from the description that as a sheet, having passed through a set of rollers (49/51 or 53,51), encounters a stop (65 or 79), the advancing edge of the sheet will be stopped momentarily. In the case of the first stop on the first guide plate, in this case stop 65, it is the leading edge of an unfolded sheet that encounters the stop. In the case of the second stop on the second guide plate, in this case stop 79, it is the folded edge of a once-folded sheet that encounters the stop.

In either case it is desirable under some circumstances to place glue spots along the edge of a sheet encountering a stop, the glue applied during the short time that the sheet is stopped. Glue spots are applied in this instance by glue actuators which are well-known in the art. Such actuators typically are connected to electrical control and power lines and to conduits conducting glue to an application tip of the actuator.

An actuator 249 is illustrated in FIG. 2 at a position relative to stop 79 providing for applicator tip 250 of the actuator to be just above a sheet encountering the stop. In this position the actuator may apply, in the brief time the sheet is stopped, a spot of glue along the edge encountering the stop, relatively close to the edge.

In FIG. 2 only one actuator is shown because the view is from one side. In most cases several actuators are mounted side-by-side allowing a row of glue spots to be placed along the edge. Such a row of glue spots provides for a folded mailer to be glued closed by passing through the next set of rollers (in this case rollers 51,55).

In conventional systems, as was described above, the guide plates (75,77) are made from metal plates having openings for exposing the edge of an advancing sheet at the stop so glue spots may be applied. The actuators in conventional systems are mounted in a relatively fixed manner to place the actuator applicator tips over the openings in the guide plates.

Figure 3A:
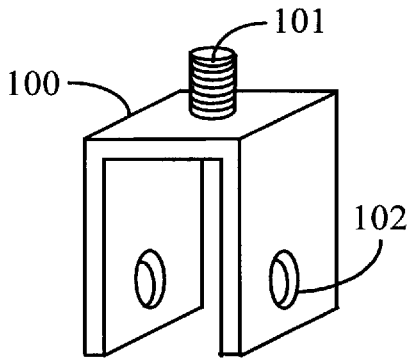
FIG. 3A is a simplified isometric view of a U-clamp as used to hold actuators in an embodiment of the present invention.

In an embodiment of the present invention paper guides and actuator mountings are provided to allow a system operator to place actuators in essentially any convenient position along an edge of a sheet encountering a paper stop FIG. 3A is an isometric view of a U-clamp used to hold actuators in an embodiment of the present invention. The U-Clamp comprises a U-shaped metal piece 100 with holes 102 through opposite legs and a set screw 101 extending through a tapped hole in the cross of the U-clamp.

Figure 3B:
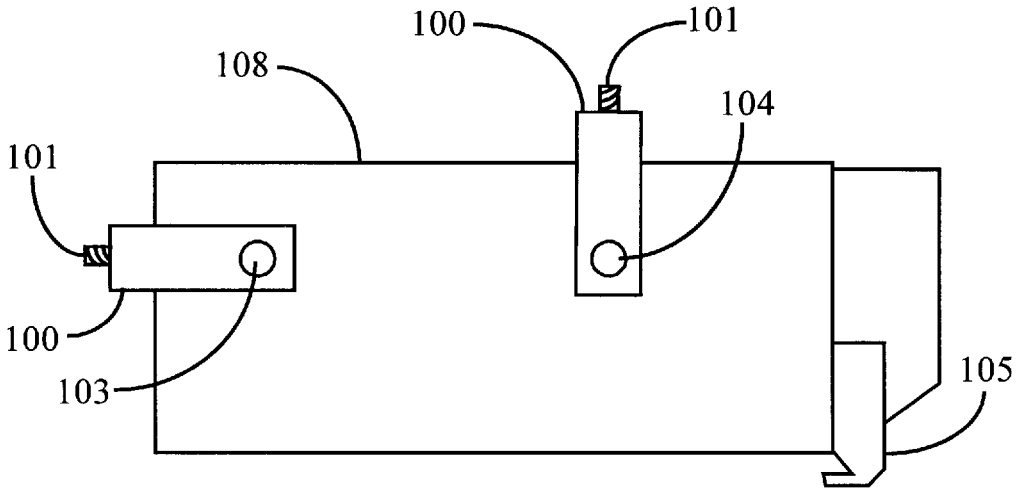
FIG. 3B is an elevation view of an actuator with two of the U-clamps of FIG. 3A mounted to the actuator.

FIG. 3B illustrates an actuator 108 having through-holes 103 and 104, and an applicator tip 105. Two U-clamps 100 are positioned such that the holes 102 of the U-clamps align with holes 103 and 104 of the actuator.

Figure 3C:
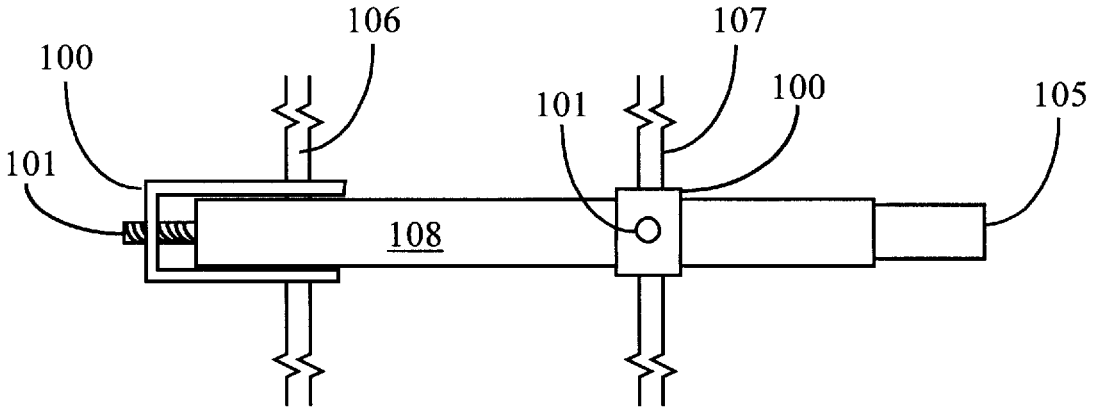
FIG. 3C is a plan view of the actuator of FIG. 3B mounted on slide rods according to an aspect of the present invention.

FIG. 3C is a plan view of the actuator of FIG. 3B showing additionally two rods 106 and 107 passing through the holes in the actuator and the holes in the U-clamps. In this arrangement, assuming rods 106 and 108 are fixed, actuator may be moved laterally along the rods, and tightenting set screws 101 will urge the U-clamps against the rods holding the actuator in position on the rods.

Figure 4:
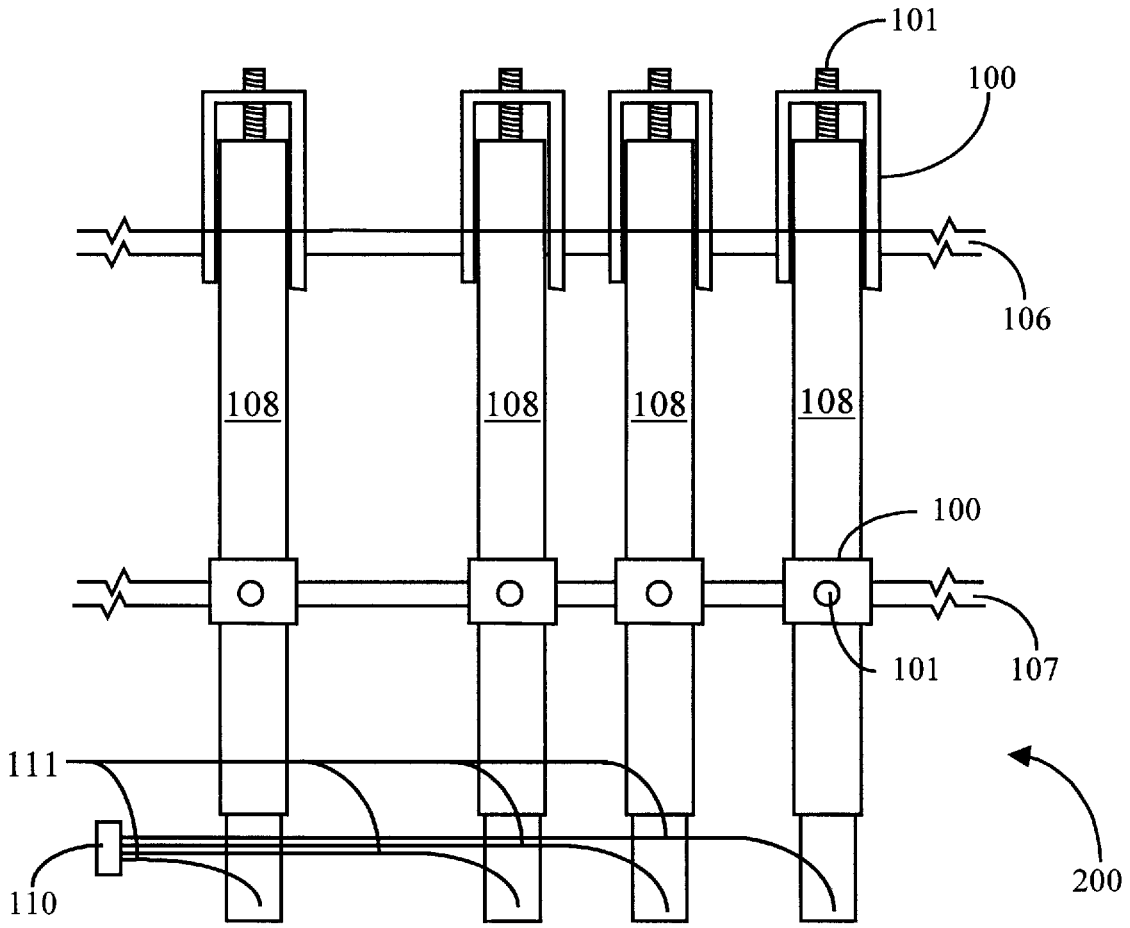
FIG. 4 is a plan view of four actuators as shown in FIG. 3C mounted on slide rods.

FIG. 4 is a plan view of a set 200 of four actuators 102 mounted side-by-side on rods 106 and 107, with each of the actuators interfaced to the rods by means of two U-clamps 100. In this arrangement all four actuators may be positioned on the rods at convenient positions and secured by tightening set screws 101. Lines 111 leading from each of the four actuators to an interface 110 represent power, control, and glue conduits serving the four actuators. It will be apparent to those with skill in the art that there could be fewer actuators or more actuators, and that there could be more than two rods for mounting actuators.

Figure 5A:
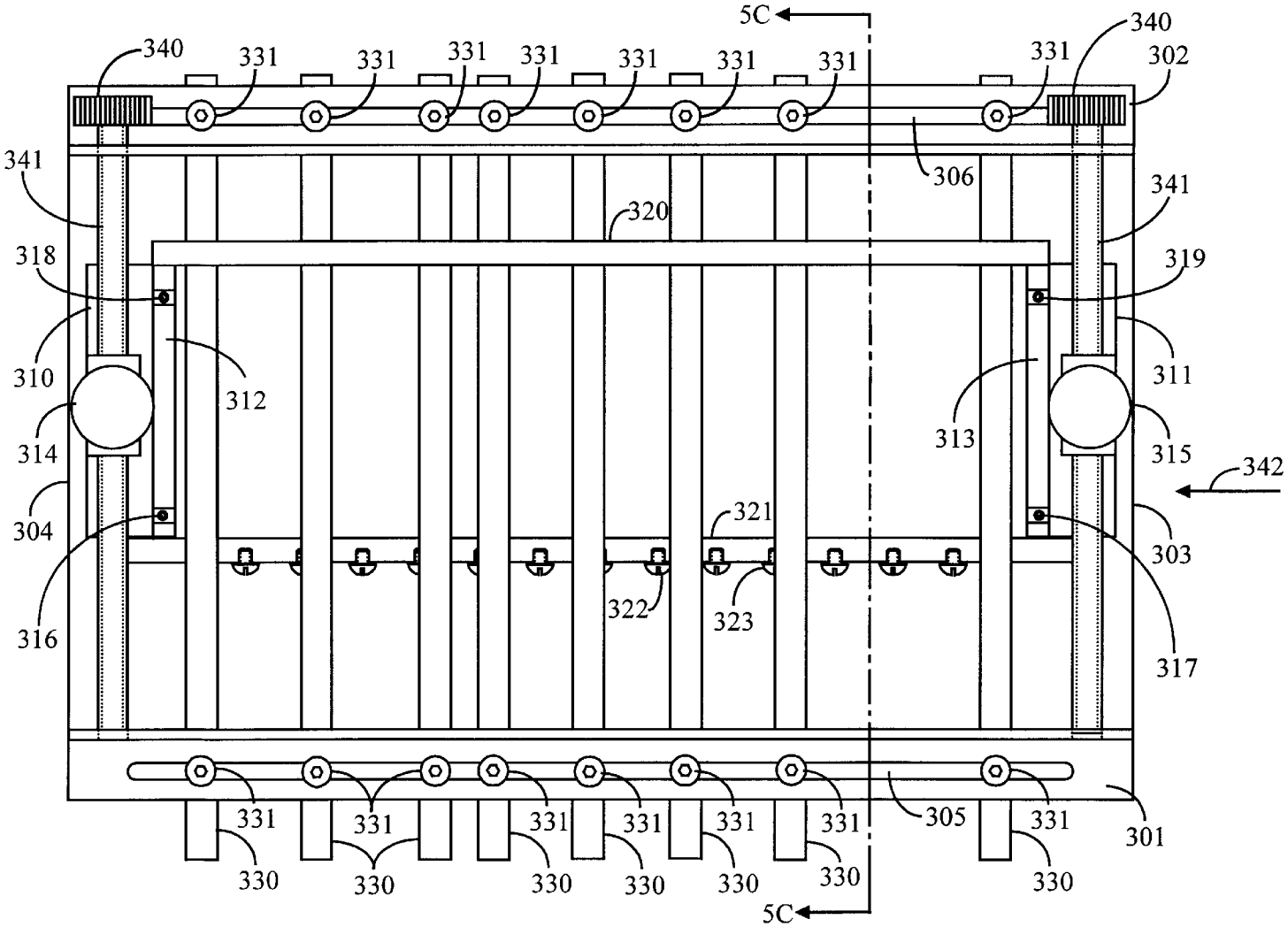
FIG. 5A is a plan view of an actuator mounting apparatus according to an embodiment of the present invention.

FIG. 5A is a plan view of an apparatus according to an embodiment of the present invention providing a paper guide, paper stop and actuator mount adapted for carrying actuators on rods as shown in FIG. 4, and for engaging the frame of a GlueFolder machine such as that shown in FIG. 1. The actuators and slide rods are not shown in FIG. 5A to better illustrate the nature of the frame apparatus. The apparatus shown in FIG. 5A replaces a conventional folding plate, such as plate 57 or 71 of FIG. 2. The Frame apparatus of FIG. 5A may be best understood with the aid of FIG. 5B, which is a side elevation view in the direction of arrow 342, and FIG. 5C, which is a cross-section view taken along section line 5C—5C of FIG. 5A.

Figure 5B:
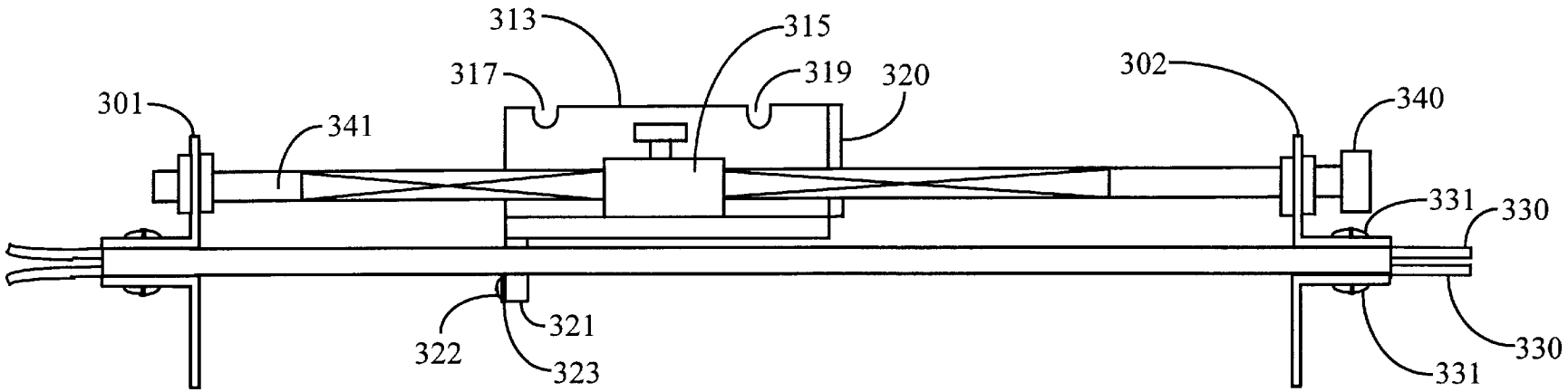
FIG. 5B is a side elevation view of the apparatus of FIG. 5A seen in the direction of arrow 342.
Figure 5C:
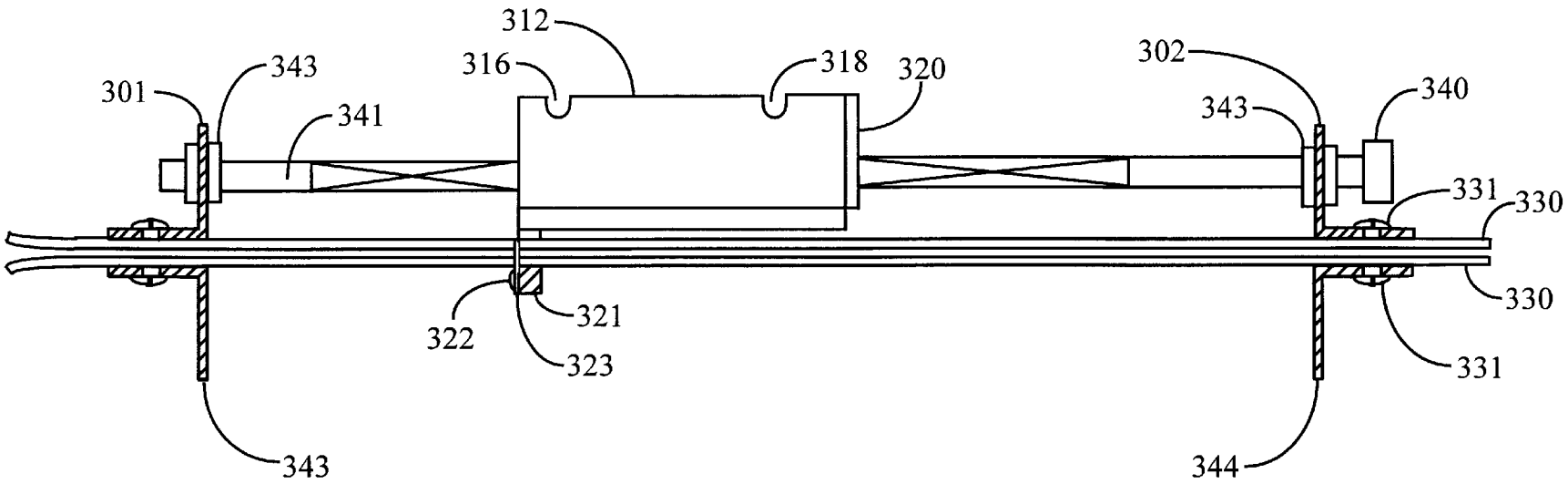
FIG. 5C is a section view taken along section line 5C—5C of FIG. 5A.

The apparatus of FIGS. 5A, B, and C comprises four L-shaped rails 301, 302, 343, and 344 fastened to side plates 303 and 304 in a manner to form a substantially rectangular framework with upper and lower L-shaped rails as seen in FIGS. 5B and 5C. Lengthwise slots such as slots 305 and 306 provide laterally adjustable mounting for a plurality of guide strips 330. Guide strips 330 are arranged in upper and lower pairs such that the plurality serve the function of guide plates in conventional apparatus. Side view 5A and cross-section 5C illustrate clearly how paper sheets may enter between the upper and lower guide strips 330. As may be seen best in FIG. 5A, guide strips 330 may be adjusted in position from side to side on the apparatus by loosening fasteners 331, moving strips, and retightening fasteners 331.

In addition to the guide strips a pair of rotatable threaded rods 341 are mounted through bearing blocks 343, one on each side of the frame apparatus, and threaded, quick-release blocks 314 and 315 engage the threaded rods. Two carriages 310 and 311 are mounted to blocks 314 and 315 respectively, and each of the carriages has an upwardly extending portion, portion 312 on carriage 310, and portion 313 on carriage 311. Portions 312 and 313 have carrier slots such as slots 316 and 318 in portion 312 and slots 317 and 319 in portion 313. The carrier slots are adapted for engaging rods 106 and 107 (See FIGS. 3C and 4), although the rod and actuator assembly of FIG. 4 is not shown in FIGS. 5A, B, and C.

Carriages 310 and 311 are connected by a bar 320 above the guide strips and a second bar 321 below the guide strips. The connection of the carriages provides for a single carriage apparatus which may be adjusted in the direction of threaded rods 341. Rough adjustment may be made by disengaging the quick-release blocks, moving the carriage, and re-engaging the quick-release blocks. Fine adjustment is made by rotating knobs 340.

Bar 321 below the guide strips is therefore below the path of paper entering between the sets of guide strips 330. Bar 321 is fitted with a plurality of rotatable tabs 323 which, in upright position, serve to block the paper path and provide a paper stop serving the function of paper stop 79 in the conventional apparatus shown in FIG. 2. These tabs in the upright position extend between guide strips 330, preventing lateral position adjustment of the guide strips. When guide strips are to be moved, therefore, it is necessary to loosen fasteners 322 and rotate tabs 323 for those tab positions blocking movement.

In a preferred embodiment bar 321 is mounted to the moveable carriage as described above, and therefore moves when the position of the carriage is adjusted. In some other embodiments bar 321 may be mounted as part of the frame, in which case the position of glue spots relative to the edge of a sheet encountering the paper stop changes with changing position of the moveable carriage.

Figure 6A:
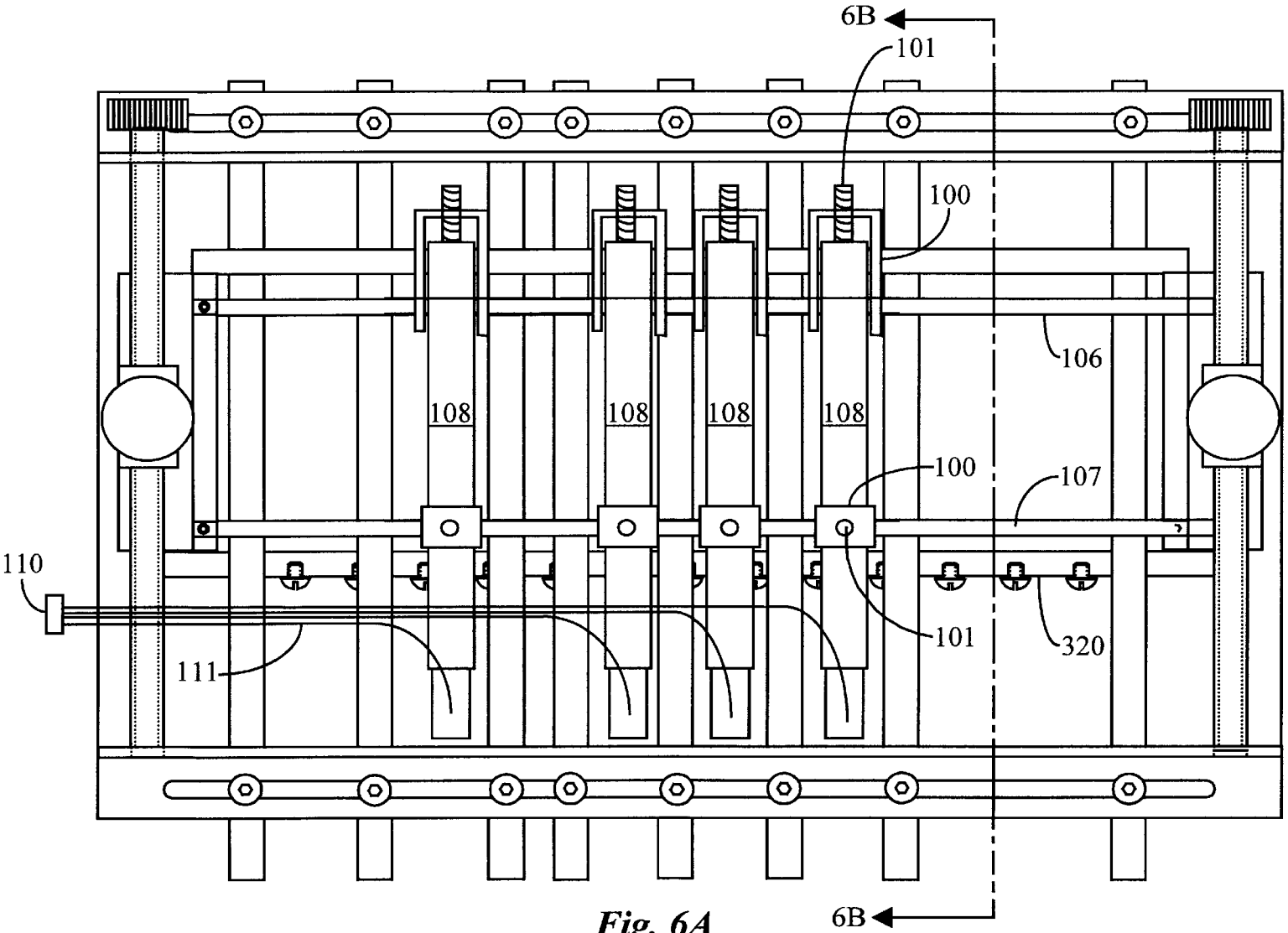
FIG. 6A is a plan view of the apparatus of FIG. 5A with the assembly of FIG. 4 mounted in a manner according to an embodiment of the present invention.
Figure 6B:
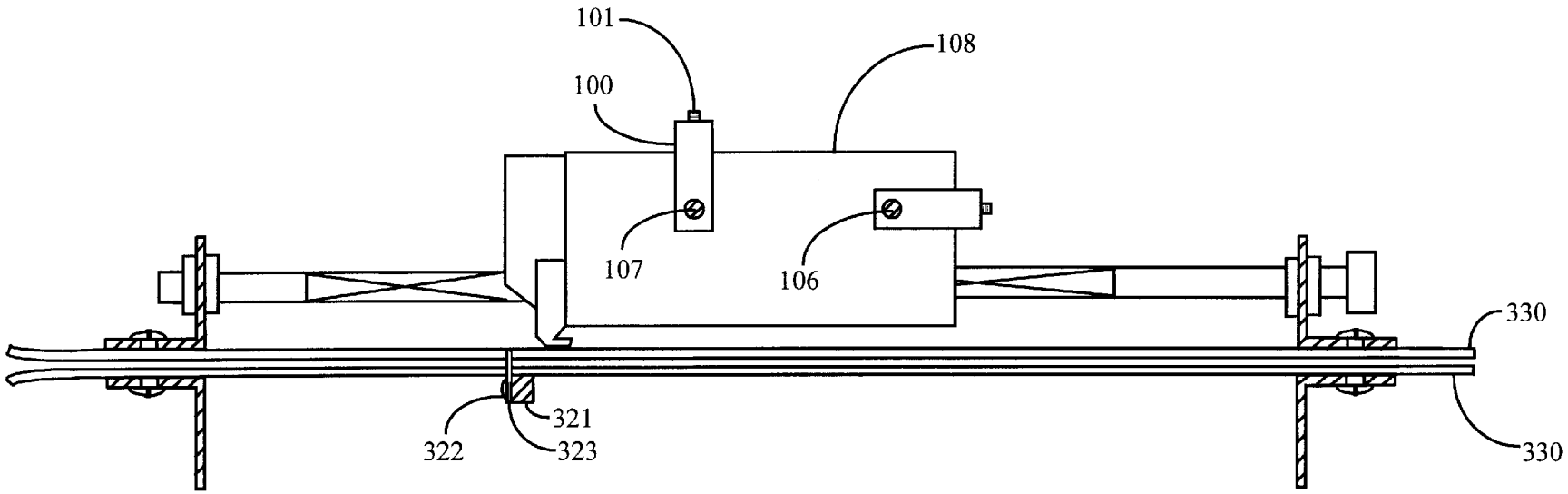
FIG. 6B is a section view taken along section line 6B—6B of FIG. 6A.

FIG. 6A is a plan view of the apparatus of FIGS. 5A, 5B, and 5C with the actuator and rod assembly of FIG. 4 carried in slots 316, 318, 317, and 319, such that the four actuators 108 are positioned over the paper path. In this assembly the glue head end of each of the actuators is toward the paper stop provided by bar 321 so spots of glue may be applied relatively close to the edge of a sheet encountering the paper stops. Although not seen in FIG. 6A, there are collars provided on rods 106 and 107 so the rod and actuator assembly engages the carriage assembly without lateral movement. FIG. 6B is a section view taken along section line 6B—6B of FIG. 6A showing one of the actuators in position in the assembly.

As may be seen in FIG. 5A, there are threaded holes at the bottom of slots 316, 318, 317, and 319. In assembly there are set screws engaged in each of these four threaded holes, such that rods 106 and 107 rest on the set screws. The height of actuators above a sheet in the paper path may be adjusted by adjusting the set screws in the threaded holes in the slots 316, 318, 317, and 319.

It will be apparent to those with skill in the art that there may be more than four actuators mounted in a single assembly, although the space available restricts the total number of actuators. There may also be fewer than four actuators. It will also be apparent that the actuators may be moved laterally to position glue spots in a wide variety of spacing and patterns. Guides 330 may similarly be moved to assure that no guide strip interferes with an actuator, and guide strip may, if necessary, be removed. Finally, it will be apparent that the rod and actuator assembly may be lifted out of the carriage assembly at any convenient time for cleaning and service. Flexible power and control lines and glue conduit lines are represented by lines 111 in FIG. 6A to interface 110. Interface 110 in some embodiments comprises quick-connect couplings and connectors such that the lines may be quickly and easily disconnected.

Although not specifically shown in the several drawing figures the frame assembly is adapted to be quickly and simply engaged to and disengaged from a GlueFolder machine. The interfaces for this engagement are the same as for the more conventional apparatus indicated in FIG. 2, and are not unique to the present invention.

It will be apparent to those with skill in the art that there will be many alterations that might be made without departing from the spirit and scope of the invention. The variance in the number of actuators that might be used has already been mentioned. There is a broad range of sizes of apparatus that may be implemented as well, and apparatus according to embodiments of the invention may be adapted to many different kinds of folding and gluing apparatus. As another example of the breadth of the invention, it will be apparent that elements may be fashioned from a variety of materials and in a variety of ways. The invention is limited only by the claims which follow:

What is claimed is:

1. A sheet stop and actuator assembly for a sheet folding apparatus, comprising:

a frame including cross members adapted for mounting to the sheet folding apparatus;

a plurality of opposed, substantially flat, guide strips slidably mounted to the cross members, the guide strips spaced apart and forming a sheet path with a width greater than the width of any sheet to be processed, wherein sheets may enter from and exit to the sheet folder apparatus, and wherein any individual guide strip may be added or deleted, and may be positioned at any position across the width of the sheet path;

an adjustable actuator carriage mounted to the frame above the sheet path, position of the actuator carriage freely adjustable in the direction of sheet movement in the sheet path, and adapted to engage at least two parallel rods extending across the width of the sheet path;

two or more glue actuators slidably mounted on two parallel rods engaging the carriage and extending across the width of the sheet path, such that the two or more glue actuators may be moved laterally along the parallel rods to any position across the width of the sheet path; and a stop bar mounted to the actuator carriage and having mount locations outside the width of the sheet path, the stop bar extending laterally across the width of the sheet path, the bar having extendible and retractable tabs adapted to extend between the guide strips across the sheet path, forming thereby a stop for sheets moving in the sheet path;

wherein combined position adjustability of the carriage and guide strips allows glue actuators to be positioned to place glue dots at any position across the width of a sheet while maintaining a sufficiency of guide strips positioned to form the sheet path.

2. The assembly of claim 1 wherein the carriage mounts by threaded blocks on threaded rods extending in the direction of sheet movement in the sheet path, whereby rotating the threaded rods adjusts carriage position along the threaded rods.

3. The assembly of claim 1 wherein the stop bar is mounted below the sheet path.

4. The assembly of claim 1 wherein the stop bar is mounted to the frame.

5. A glue actuator assembly for a sheet folding apparatus, comprising:

a frame including cross members adapted for mounting to the sheet folding apparatus;

a plurality of opposed, substantially flat, guide strips slidably mounted to the cross members, the guide strips spaced apart and forming a sheet path with a width greater than the width of any sheet to be processed, wherein sheets may enter from and exit to the sheet folder apparatus, and wherein any individual guide strip may be added or deleted, and may be positioned at any position across the width of the sheet path; and an actuator carriage mounted to the frame above the sheet path, the carriage freely adjustable in the direction of sheet movement in the sheet path and further comprising two or more glue actuators slidably mounted on bars extending laterally across the sheet path width;

wherein the two or more glue actuators slidably mounted on bars may be moved to different positions along the bars and the guide strips may be positioned to allow the glue actuators access to sheets in the sheet path.

6. The glue actuator assembly of claim 5 wherein the carriage is mounted on threaded rods extending in the direction of sheet movement in the sheet path, and the carriage is adjusted by rotating the threaded rods.

7. The glue actuator assembly of claim 5 further comprising a stop bar extending across and below the sheet path, the stop bar having extendible tabs adapted to extend between individual ones of the guide strips, forming thereby a stop for sheets moving in the sheet path.

8. The glue actuator assembly of claim 7 wherein the extendible tabs are tabs mounted on single fasteners away from the center of each tab and the tabs are extended by rotation.

* * * * *